US005611559A

United States Patent [19]

Luitz et al.

[11] Patent Number: 5,611,559

[45] Date of Patent: Mar. 18, 1997

[54] BINDING UNIT BETWEEN A BOOT AND AN ITEM OF SPORTS EQUIPMENT

[75] Inventors: Max Luitz, Blaichach-Bihlerdorf; Hans Frick, Wiggensbach, both of Germany

[73] Assignee: Varpat Patentverwertungs AG, Littau, Switzerland

[21] Appl. No.: 270,147

[22] Filed: Jul. 1, 1994

[30] Foreign Application Priority Data

Jul. 5, 1993 [AT] Austria ..... 1321/93

[51] Int. Cl.[6] ..... A63C 9/22

[52] U.S. Cl. ..... 280/617; 280/633

[58] Field of Search ..... 280/616, 618, 280/633, 634, 617

[56] References Cited

U.S. PATENT DOCUMENTS

| | | | |
|---|---|---|---|
| 3,987,553 | 10/1976 | Salomon | 280/616 |
| 4,441,733 | 4/1984 | Spitaler | 280/633 |
| 4,444,414 | 4/1984 | Bauer | 280/633 |
| 4,506,905 | 3/1985 | Krob et al. | 280/633 |
| 4,519,625 | 5/1985 | Luitz et al. | 280/633 |
| 4,955,633 | 9/1990 | Stritzl | 280/618 |
| 5,188,388 | 2/1993 | Rohrmoser | 280/633 |
| 5,344,179 | 9/1994 | Fritschi | 280/618 |

FOREIGN PATENT DOCUMENTS

| | | |
|---|---|---|
| 371731 | 7/1983 | Austria . |
| 2617395 | 4/1978 | Germany . |
| 3214585 | 10/1983 | Germany . |
| 3109754 | 4/1988 | Germany . |

*Primary Examiner*—Anne Marie Boehler
*Attorney, Agent, or Firm*—Collard & Roe, P.C.

[57] ABSTRACT

The invention describes a binding unit (2) between a boot and an item of sports equipment, in particular a ski binding, with a front jaw (3) and a rear jaw (4) which are connected to each other at a presettable distance (6) by a connecting element (5) and form a binding unit (2) which is slidable in the longitudinal direction of the ski (1) in a longitudinal guide (8) which is arranged on the ski and can be fixed thereon. The binding unit (2) comprises a locking device (10) for locking the binding unit (2) relative to the longitudinal guide (8) or ski (1). Between the binding unit (2) and the longitudinal guide (8) and/or the item of sports equipment is arranged an adjusting device (13) which includes supporting elements fixed to the ski at a distance one behind the other in the longitudinal direction of the binding unit (2), e.g. transverse webs between latching slots in a latching strip, and at least one setting member which comprises an actuating member. On application of pressure to the actuating member and adjustment by a first adjusting distance, the setting member of the adjusting device (13) is inserted between at least two supporting elements, and after a greater second adjusting distance the locking device is unlocked.

26 Claims, 8 Drawing Sheets

Fig. 9
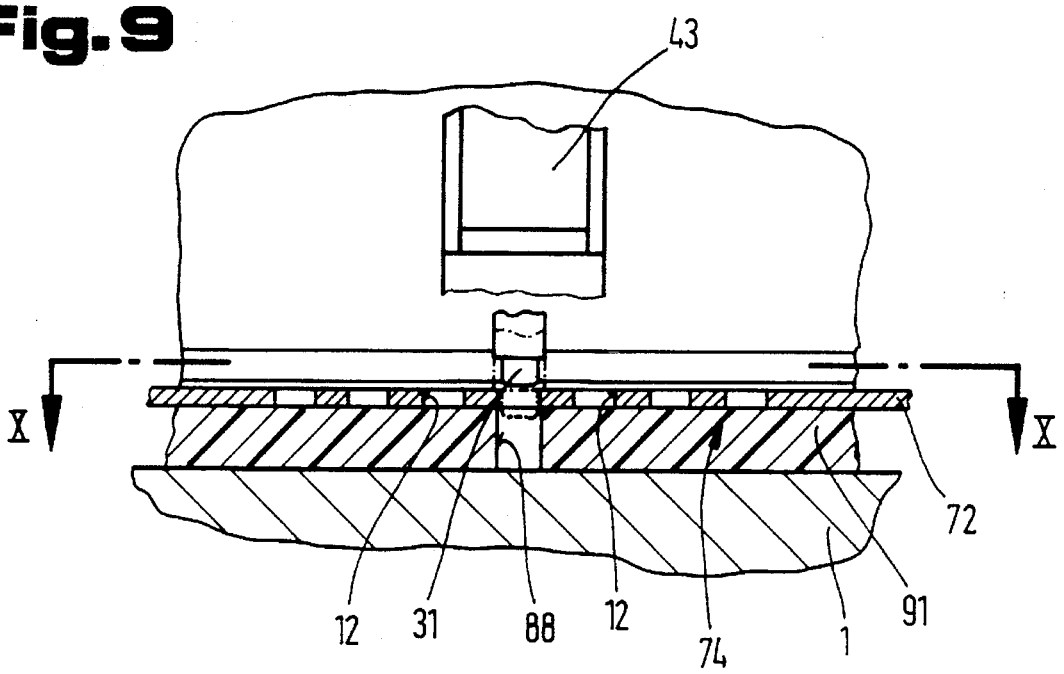
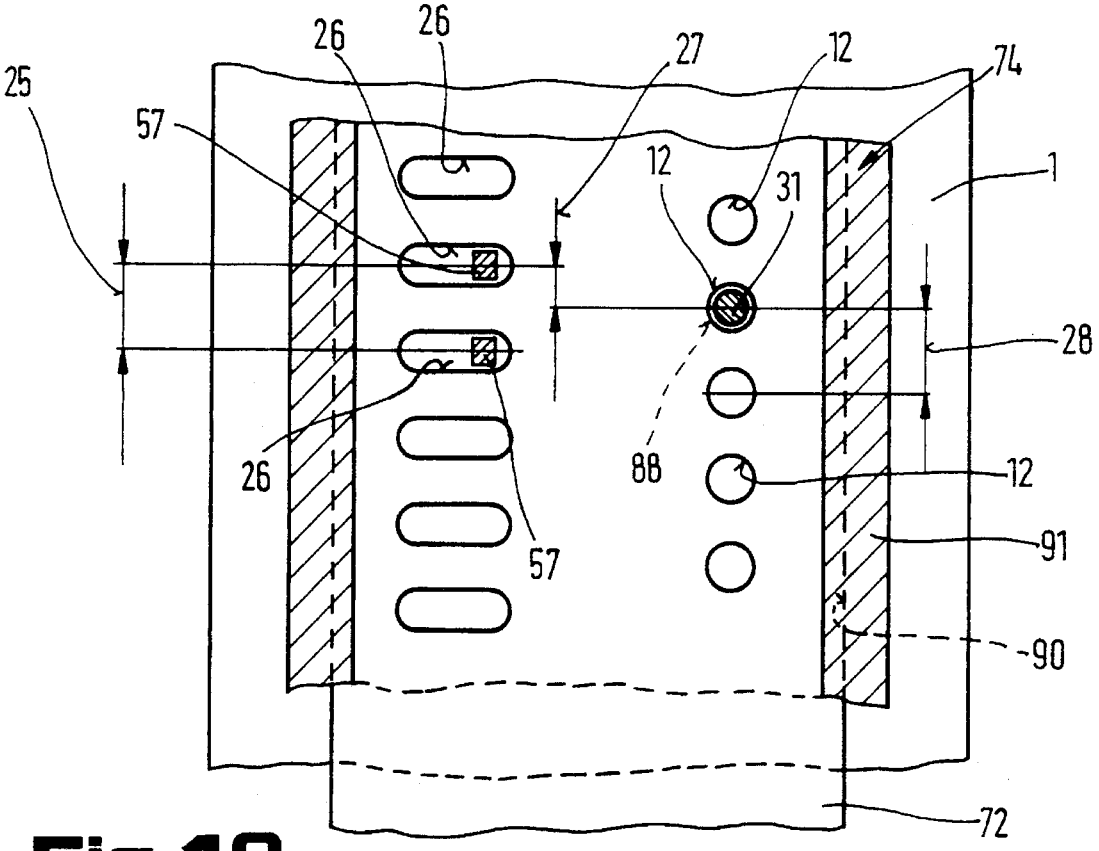
Fig. 10

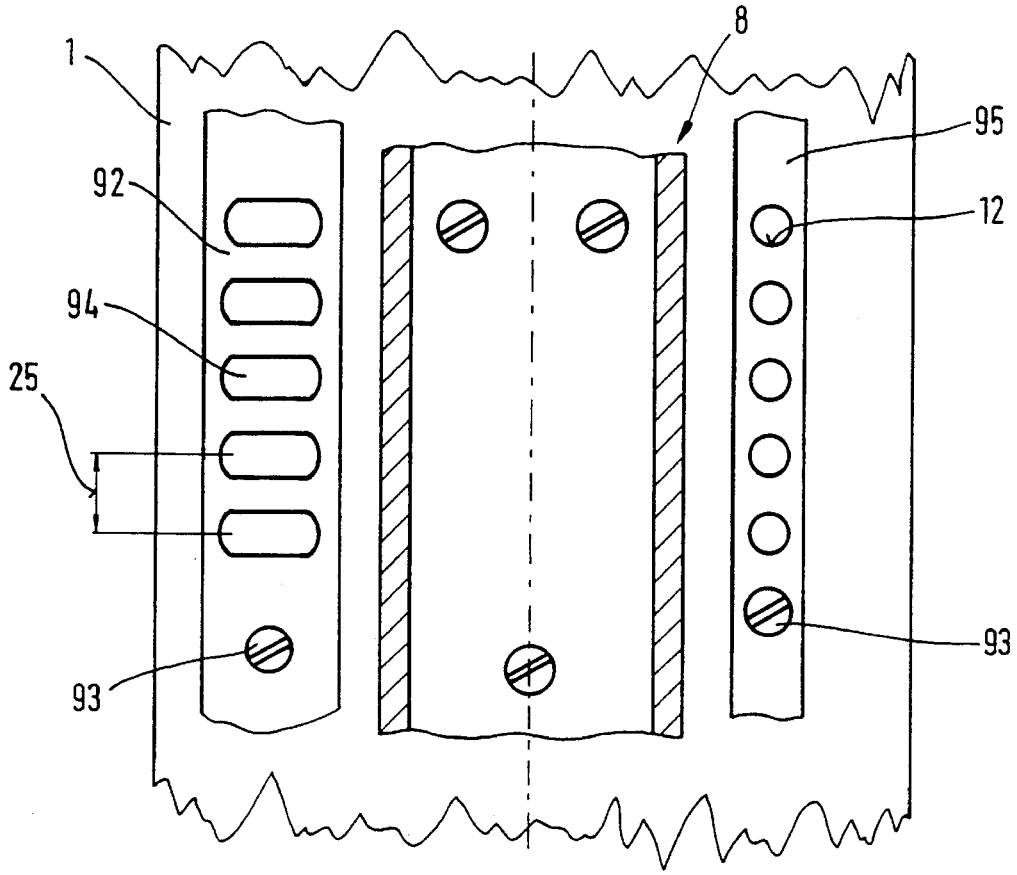
Fig.11
Fig.12
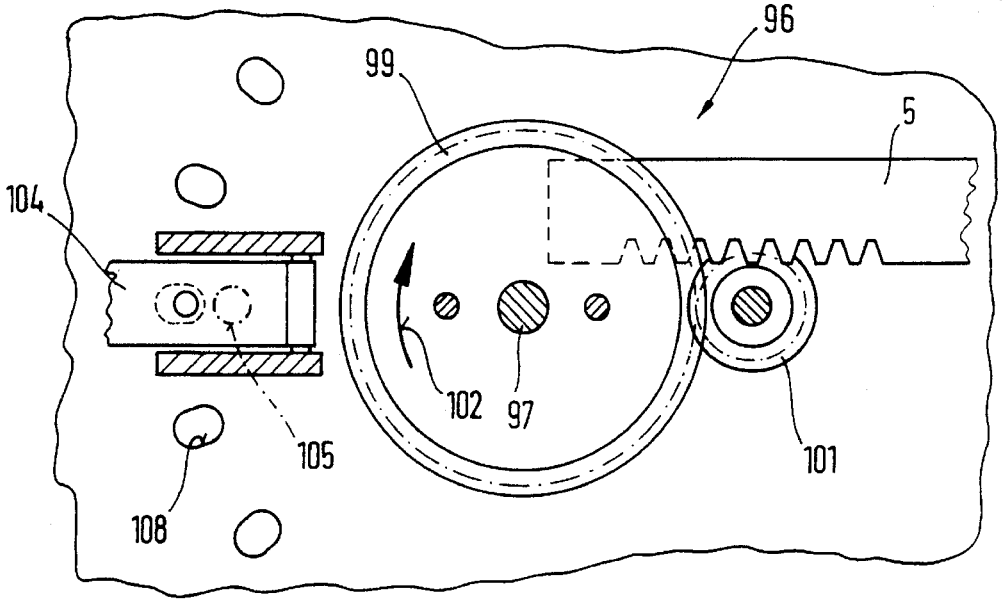

BINDING UNIT BETWEEN A BOOT AND AN ITEM OF SPORTS EQUIPMENT

BACKGROUND OF THE INVENTION

1. Field of the Invention

The invention describes a binding unit.

2. The Prior Art

A known binding unit according to DE-A-3 214 585 consists of a binding unit which comprises front and rear jaws connected by a connecting element and is guided slidably in a guide track in the longitudinal direction of the ski and can be latched in several sliding positions by means of a latching device. In the front or rear jaw is provided an engagement opening accessible from above for the point of a ski stick, which comprises two guide surfaces pointing in the longitudinal direction of the ski for the ski stick. In the region of this engagement opening below the front jaw in the longitudinal direction of the ski are provided several engagement openings arranged one behind the other, in which the point of the ski stick engages on insertion in the engagement opening. To lock the binding unit on the ski a latching device is provided, comprising a latching profile which is adjustable against the action of a latching spring in the housing of the jaw and by which the jaw in the locking position is in form-locking engagement with a counterlatching profile which periodically repeats itself in the longitudinal direction of the ski. Furthermore, in the housing an actuating portion is mounted for pivoting about a shaft extending parallel to the connecting element between front and rear jaws, which by one end protrudes into the region of the engagement opening for the ski stick and of which the other end is in engagement with the latching profile portion. On insertion of the ski stick in the engagement opening, the actuating portion is pivoted, so that the latching profile portion can be disengaged from the counterlatching profile and hence adjustment of the binding unit with the ski stick is released. For adjustment, the ski stick is to be pivoted by feel so far that the latching profile portion is located above an opening in the counterlatching profile portion. For latching the binding unit relative to the ski, the front jaw is to be further moved back and forth slightly with the ski stick until the latching profile portion has engaged in the counterlatching profile. Adjustment of the binding unit by predefined quantities is possible in this case only with difficulty.

SUMMARY OF THE INVENTION

It is the object of the present invention to allow exact adjustment of the binding unit in the longitudinal direction relative to the ski and to ensure reliable locking after completion of the adjusting movement.

This object of the invention is achieved in that a binding unit between a boot and an item of sports equipment consists of a ski binding with a front jaw, a rear jaw and a connecting element connecting the front jaw and the rear jaw to each other at a presettable distance, a longitudinal guide track which is arranged on the ski, whereby the ski binding is guided in the longitudinal direction; a locking device to lock the binding to the longitudinal guide or ski; an adjusting device between the ski binding and the longitudinal guide track which includes a setting member, a supporting element and an actuating member which on application of pressure comprises a first shorter adjusting distance, whereby the setting member is inserted between at least two supporting elements and a second longer adjusting distance, whereby the locking device is unlocked.

The advantage with this solution is that adjustment of the binding unit by a precisely predefined amount between two successive locking positions takes place. But the adjusting movement is thus also limited at the same time, so that undesirable slipping of the binding unit out of one end position into the other opposite end position, past a plurality of intermediate positions, is prevented. The surprising advantage of this solution lies above all in that now, at the end of the precisely predefined pivot movement, the portions of the locking device which bring about locking are in a position of register, and therefore on release of the adjusting device by the ski stick via this adjusting device the binding unit is further kept positioned until the locking pin of the locking device is latched in the locking bore associated with it and so exact locking of the binding unit is achieved. At the same time it is thus ensured that the locking pin and the locking bore are centred on each other during the locking operation and so reliable engagement and reliable locking of the binding unit in the new desired position is achieved.

Added to this is that due to this solution the adjustment of the binding unit is now completely independent of the design of the ski stick, as the sliding movement of the binding unit takes place via its own adjusting device which is arranged in exact coordination with the locking positions, as a result of which support of the ski stick on the housing of the front or rear jaw is also avoided and a more generous design construction thereof is possible.

It is advantageous in the embodiment wherein the setting member is formed by a pivot plate which is adjustable about a cardan pivot device relative to a housing of a front jaw or a rear jaw that both release of the locking device and limiting of the adjusting movement can take place in a simple manner by the pivot plate.

In an embodiment wherein the cardan pivot device is mounted for pivoting in the housing about a pivot shaft extending more or less parallel to the longitudinal axis of the connecting element, e.g. journals, and the pivot plate is pivotable about the journals as well as a pivot shaft extending essentially perpendicularly thereto, it is advantageous that due to the arrangement of the pivot pins in relation to the pivot plate, relatively long adjusting distances for adjustment can be achieved with low overall heights, wherein above all it is ensured here that even in case of accidental removal of the actuating member or ski stick, the pivot plate is pivoted into the inoperative position and the locking device is activated, so that in case of a minor stress and a resulting relative displacement between binding unit and ski, the binding unit is locked to the ski automatically.

The development wherein the cardan pivot device is arranged on the side of the pivot plate facing away from the longitudinal guide or on the side facing away from the supporting elements, and also the side of the pivot plate facing towards the supporting elements comprises at least two latching projections which project in the direction of the longitudinal guide and which are arranged at a distance from each other which essentially corresponds to a distance between latching slots immediately adjacent to each other in the direction of the longitudinal centre axis, is advantageous, because due to division of the force of advance between two latching projections, the load on the latching slots can be reduced and the transmission of a high adjusting force can be ensured.

Another embodiment wherein the pivot plate in its end region facing towards the recess for introduction of the rod-shaped actuating member is provided with stops projecting in the direction of the housing, e.g. side strips, and preferably in this region has a more or less U-shaped cross-section, whereby high adjusting forces can be transmitted via the pivot plate satisfactorily too and hence relative adjustment between the binding unit and ski is possible when the ski boot is mounted in the binding unit, that is, during use of the ski or sports equipment.

But a development wherein the side strips in their end region facing towards the latching projections form a stop to the inner wall of the housing is possible too, in which it is advantageous that the side strips which are there anyway can be used as end stops in order to keep the adjusting device always in a position ready for use.

Also advantageous is an embodiment wherein in the inoperative position the latching projections are disengaged from the supporting elements or the latching slots arranged therebetween in the longitudinal guide, because as a result rapid return of the pivot plate to the starting position is obtainable with the position of the binding unit secured.

With another development wherein the latching projections are in the inoperative position above an upper side of a base of a C-shaped profile of the longitudinal guide, it is achieved that the longitudinal guide track which is necessary for guiding can simultaneously be used as a supporting element for adjustment of the binding unit, due to arrangement in the base of the C-shaped profile, that is, between the upwardly projecting arm, tilting of the front or rear jaw in the longitudinal guide track can be prevented during adjustment.

By an advantageous embodiment wherein the ski stick is inserted between the pivot plate and an inner wall of the housing, the latching projections are then in the engaged position and engage in a supporting element in latching slots immediately adjacent on both sides, it is ensured that on insertion of the actuating member or element needed for adjustment, in particular the ski stick, the latching projections automatically become engaged with the latching slots and hence adjustment of the binding unit true to dimensions is possible.

Easy actuation of the pivot plate is achieved by the construction wherein the pivot plate is pivotable about the journals for adjustment from the inoperative position to the engaged position.

Furthermore a construction wherein the pivot pin is mounted for rotation about the pivot shaft in the pivot body of the cardan pivot device is also advantageous, because as a result a solid construction of the bearing point or of the pivot device is made possible, which allows the transmission of a high adjusting force without damage to the mechanical parts.

Repeated use of the components can be achieved by the development wherein the pivot pin on its end opposite the pivot plate is provided with a lifting member projecting beyond the pivot body, because as a result the pivot pin which is there anyway, can simultaneously be used to activate the locking device.

Another construction describes that the lifting member is engaged by an attachment with a control head of a locking pin of the locking device, as a result of which synchronous actuation of the pivot plate and locking pin of the locking device is obtained, i.e. engagement of the pivot plate for the adjusting movement and diametrically opposed release of the binding unit for adjustment, by eliminating the locking action of the locking device.

Furthermore, a construction wherein a locking extension of the locking pin engages in a locking bore, preferably in the longitudinal guide, when the pivot plate is in the inoperative position, is possible too, which, after removal of the actuating member or ski stick from the adjusting device, forces the locking device into a standby position because, with the slightest relative movement between connecting element or adjusting device or front or rear jaw and ski, automatic locking can take place. Hence, the risk of operating errors or the risk of accidents if positive locking of the control unit has not taken place is additionally reduced.

Also advantageous is a construction wherein the locking pin with its locking extension is biassed under the action of a compression device, in particular a compression spring, in the direction of the locking bore, e.g. in the longitudinal guide or in the ski, because as a result the initial tension of the locking device for automatic locking after removal of the actuating member can be utilised simultaneously for return of the pivot plate to the inoperative position.

Another development describes that when the pivot plate is in the engaged position, the control head is held by the lifting member in a release position in which the locking extension is located outside the locking bore, e.g. above a surface of the longitudinal guide or of the ski, as a result of which, when the pivot plate is in the engaged position for adjustment, it is ensured that the locking action of the locking device is eliminated.

Due to the development wherein in the engaged position of the pivot plate, the latter is oriented essentially perpendicularly to the longitudinal guide or to the surface of the ski and parallel to the longitudinal centre axis of the connecting element and preferably extends more or less parallel to the locking pin, after each adjusting operation with the adjusting device and locking of the binding unit in the new position, the two tooth segments or latching projections in each case in a more or less vertical position engage in the latching slots or teeth.

By the construction wherein the locking bores are offset from the latching slots in the direction of the longitudinal centre axis by a distance which corresponds to half the distance between latching slots immediately adjacent to each other, it becomes possible to adjust adjusting devices over greater longitudinal ranges as well and to allow in each case exact locking.

Also advantageous is the construction wherein the distance between the latching slots and a spacing between the locking bores are of equal quantity, because as a result in each case after adjustment of the binding unit by a distance between the latching slots corresponding to the spacing, locking of the binding unit is possible.

Furthermore, by the construction wherein the latching slots and the locking bores are arranged in rows extending parallel to each other and to the longitudinal centre axis, it is also possible to arrange the supporting elements or latching slots, e.g. in the side plates of the profiles of the longitudinal guide means.

A generous design of the adjusting device and locking device, in particular the conversion of such devices in the case of existing bindings, is facilitated by the construction wherein the supporting elements or the latching slots and the locking bores are arranged in the longitudinal guide in the profile.

By the further construction wherein the supporting elements or the latching slots are arranged in a profile, it is made possible to use a profile which is customary in the trade or a rack or the like for the construction of the supporting elements or the latching slots arranged between them.

Universal adaptation and use of the binding unit according to the invention is achieved by the development wherein the supporting elements or the latching slots are arranged in a separate component attached to the ski.

Locking and fixing of the binding unit capable of withstanding high loads is achieved by the construction of the binding unit wherein the locking pin is supported longitudinally slidably in a guide of the housing.

By the construction wherein the pivot plate is provided with a stop projecting in the direction of the housing for one end face of the ski stick, it is ensured that on insertion of the actuating member or ski stick in the adjusting device, the latter cannot be damaged by actuating members slipping off, even with different thicknesses of the actuating member.

But also advantageous is an embodiment wherein the pivot plate comprises a contact face which in the inoperative position of the pivot plate abuts against a levelling face of the housing, which ensures that after every adjusting operation has taken place by a notch spacing the adjusting device returns to its inoperative or starting position for a further adjusting operation without effect from outside, and this return is triggered by the locking movement of the locking device, so that additional return devices such as springs are not needed.

By the development wherein a longitudinal axis of the pivot plate in the inoperative position extends parallel to a longitudinal axis of the locking pin, a restriction of the adjusting operation is already ensured by the construction of the housing.

Also advantageous is a construction wherein an aperture in the housing, through which extends the pivot plate or the latching projections thereof, or a distance between stops spaced apart from each other in the direction of the longitudinal centre axis, corresponds to a width of the pivot plate in the direction of the longitudinal centre axis plus twice the distance, and the aperture or the stops are arranged centrally to the pivot shaft of the pivot plate in the inoperative position thereof, because as a result, an adjusting distance of equal quantity for adjustment of the binding unit in the direction of the front jaw or rear jaw can be obtained.

Finally it is advantageous if a construction wherein on the pivot body is mounted a lifting member with an attachment which cooperates with the control head of the locking pin, is used, because then rapid exchange of the pivot member or pivot plate of the adjusting device in case of damage is made possible, without the locking device having to be dismounted or dismantled as well.

It is advantageous in the construction wherein the actuating member of the adjusting device is formed by an actuating element mounted adjustably in the housing in the direction of adjustment between inoperative position and engaged position, that adjustment of the binding unit is possible even without using a ski stick by manual actuation of the actuating element, wherein even in case of manual adjustment, definite fixing of the adjusting distance and hence reliable locking of the binding unit can be obtained after an adjusting operation in any direction.

The development wherein the actuating element is pivotable in the housing of the front or rear jaw about a shaft extending parallel to the longitudinal direction of the retaining element and preferably forms an outer surface of the housing, allows gripping of the front or rear jaw with the hand, wherein the adjusting device can be actuated and the locking device unlocked simultaneously with the thumb.

It is advantageous in the construction wherein the pivot lever in the longitudinal direction of the retaining element has a more or less L-shaped cross-section, wherein one arm forms the outer surface of the housing and another arm in the inoperative position of the pivot plate abuts against the latter that without elaborate additional mechanical transmission means, actuation of the pivot plate is possible.

By the construction wherein the pivot plate is constructed with stops, e.g. side strips, for supporting the actuating member formed by a ski stick, and the pivot lever is simultaneously associated with the latter as an additional actuating member, manual or semi-automatic actuation is achieved selectively via the ski stick, as a result of which both when the ski boot is fixed to the ski and when the ski boot is released from the ski, rapid adjustment of the binding unit relative to the ski is made possible.

A development wherein in the region of the front jaw of the binding unit is arranged an actuating member which is pivotable about a shaft extending more or less perpendicularly to the assembly surface of the binding unit and which is coupled to a gear and wherein the gear meshes via a gear transmission by means of a driving gear with a rack of the connecting element is distinguished in that by pivoting the actuating member, the position of which is readily apparent visually for a user of the binding unit, the binding unit can be adjusted rapidly between the different positions relative to the bearing surface or the ski.

An embodiment of the binding unit wherein associated with the actuating member is a locking device which includes a locking pin adjustable by a spring element in the direction of a bearing surface of the binding unit, allows reliable locking and anchoring of the binding unit during use and ensures that on release of the actuating element of the locking device, the latter is automatically locked in case of further adjustment.

BRIEF DESCRIPTION OF THE DRAWINGS

The invention is described in more detail below with the aid of the practical examples shown in the drawings. They show:

FIG. 9 the adjusting device in a simplified side view in section along the lines IX—IX in FIG. 7;

FIG. 10 the adjusting device in a top view, in section along the lines X—X in FIG. 9;

FIG. 11 a variant of the adjusting device with a latching strip for the pivot plate attached to the ski independently, in a simplified schematic top view;

FIG. 12 another embodiment of an adjusting device in a simplified schematic top view in section along the lines XII—XII in FIG. 13;

DETAILED DESCRIPTION OF PREFERRED EMBODIMENTS

Figure 1:
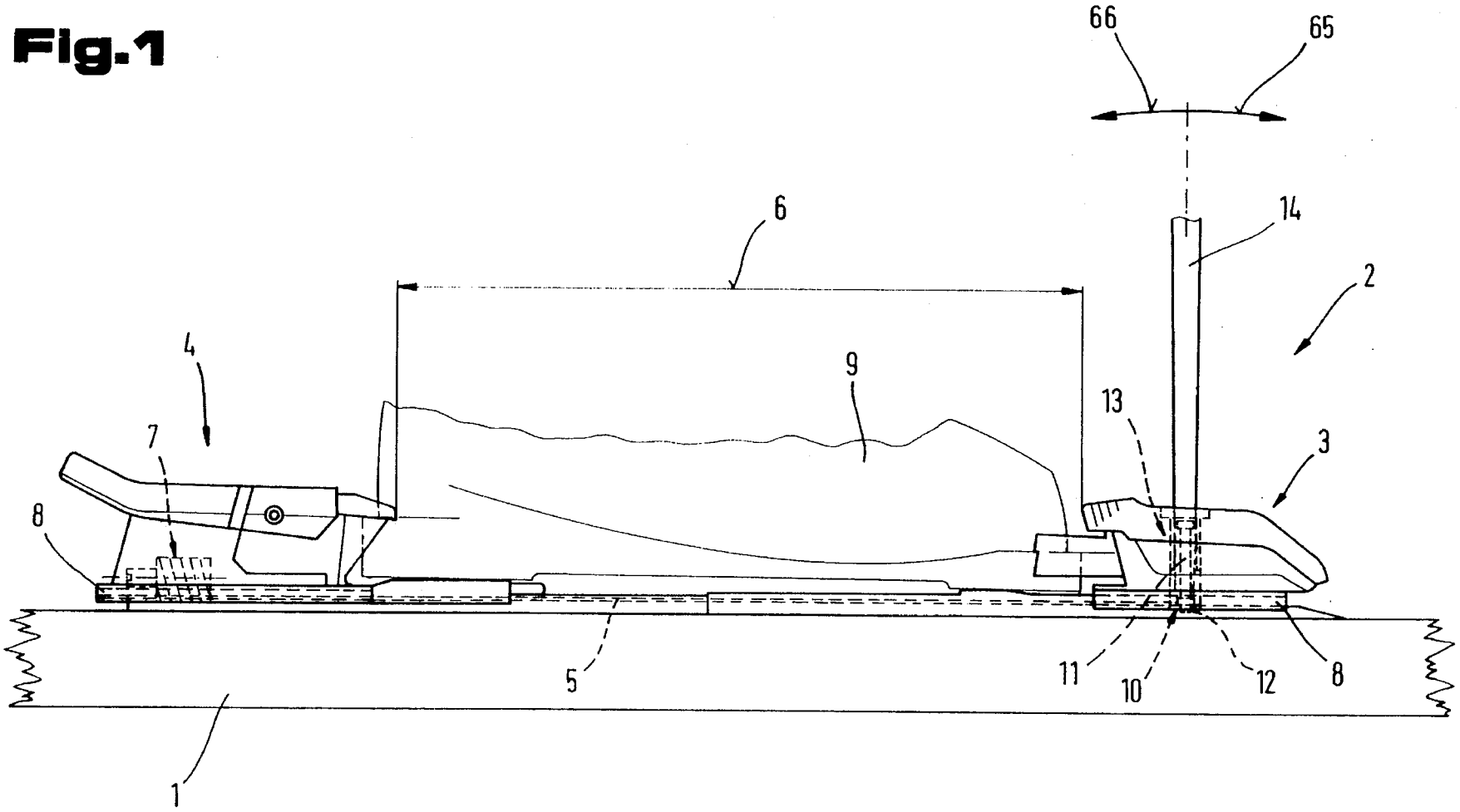
FIG. 1 part of a ski with the binding unit according to the invention arranged thereon, in a schematic side view.

In FIGS. 1 to 5 is shown a ski 1 with a binding unit 2, consisting of a front jaw 3 and a rear jaw 4. Both the front jaw 3 and the rear jaw 4 of the binding unit 2 are spaced apart from each other at a distance 6 by a connecting element 5. In this practical example the distance 6 between front jaw 3 and rear jaw 4 is settable to different boot sizes by means of a setting device 7 which is arranged in the rear jaw 4 and/or between two portions of the connecting element 5.

Further, the binding unit 2 comprises in the region of both the front 3 and the rear jaw 4 on the ski 1 longitudinal guides 8 which are connected stationarily to the latter and in which the jaws connected to each other by the connecting element 5 can be adjusted together in the longitudinal direction of the ski 1 in relation to the latter. In the process it is ensured by the connecting element 5 that the distance 6 between the front jaw 3 and the rear jaw 4 and hence for a ski boot 9 arranged therebetween is not altered, as a result of which the preset release values for the user of such a binding unit 2 are not altered.

In order to achieve fixing in position of the binding unit 2 in the longitudinal guides 8 in relation to the ski 1, a locking device 10 is mounted on top in the front jaw 3 or integrated in this front jaw 3. Naturally it is also possible to attach this locking device 10 to the rear jaw 4 or integrate it therein.

The locking device 10 is formed by a locking pin 11 which engages in locking bores 12 in the longitudinal guide 8. Easy, reliable and above all stepwise adjustment of the binding unit 2 in the longitudinal direction of the ski 1 is ensured by an adjusting device 13 likewise arranged in the front jaw 3. Actuation of the adjusting device 13 takes place by a rod-like actuating member such as, e.g. a ski stick 14 of the user. The precise manner of operation of both the locking device 10 and the adjusting device 13 is described in more detail in the figures below.

In FIGS. 2 to 5 both the locking device 10 integrated in the front jaw 3 and also the adjusting device 13 are shown on a larger scale.

Figure 2:
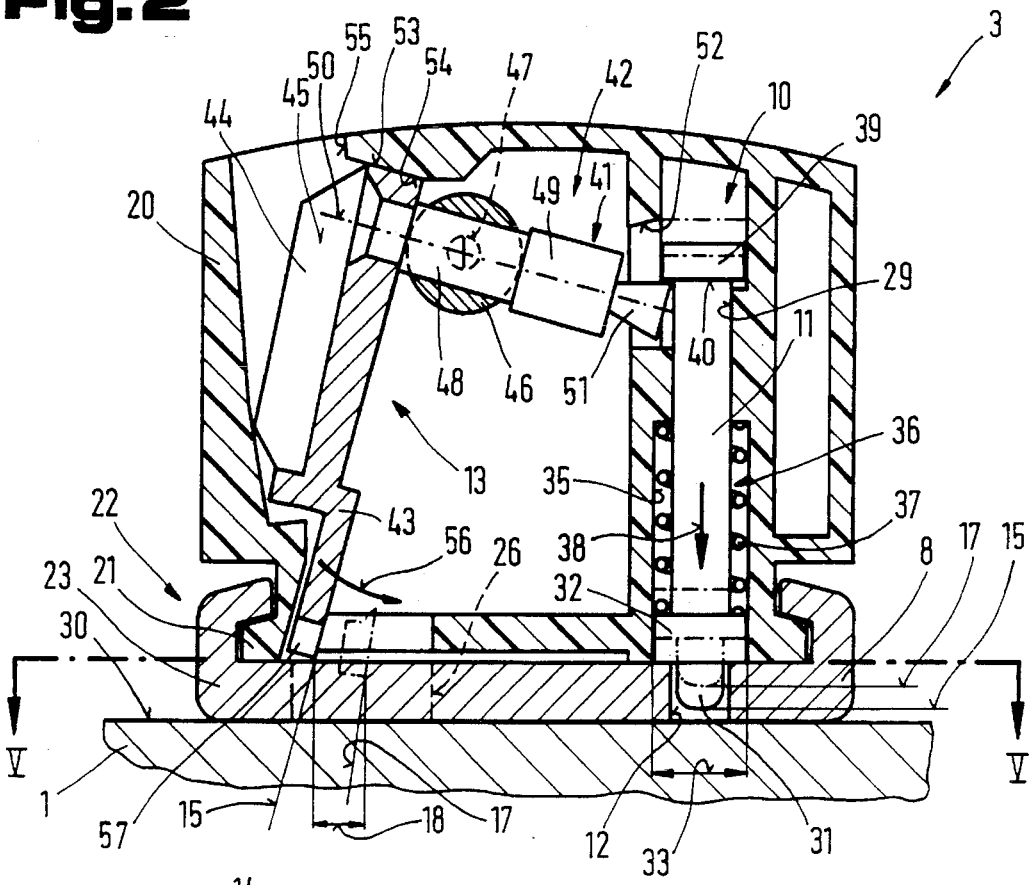
FIG. 2 the front jaw in the region of the locking or adjusting device in cross-section schematically enlarged in the locking position.
Figure 3:
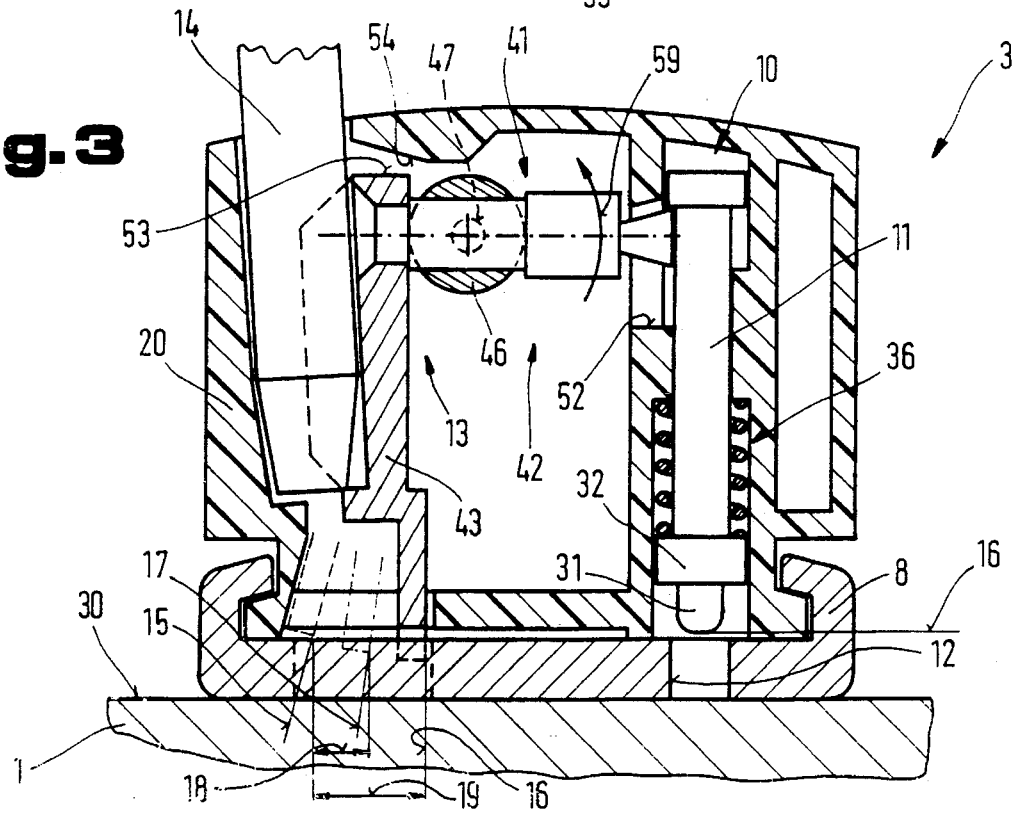
FIG. 3 the front jaw according to FIG. 2 in cross-section, but in the unlocked position of the locking device.

Further, in each of FIGS. 2 and 3 can be seen an inoperative position 15, an engaged position 16 and an intermediate position 17, which are reached by means of the ski stick 14 after a first adjusting distance 18 or a second adjusting distance 19 of the adjusting device 13.

In detail, the adjusting device 13 is arranged in a housing 20 of the front jaw 3.

The housing 20 of the front jaw 3 comprises, in the region facing towards the ski 1, extensions 21 of a guide device 22 which engage in a C-shaped profile 23 formed by the longitudinal guide 8, and hence there is exact guiding of the front jaw 3 in the longitudinal direction of the ski both vertically and laterally.

The profile 23 of the longitudinal guide 8 comprises, in the region which faces towards the adjusting device 13, latching slots 26 spaced apart from each other by a distance 25 in the direction of the longitudinal centre axis 24 of the binding unit 2. The longitudinal extent of the latching slots 26 extends transversely here, that is, at right angles to the longitudinal centre axis 24 of the binding unit 2. Further, in the region of the locking device 10 in the profile 23 of the longitudinal guide 8 are arranged the locking bores 12 which in the direction of the longitudinal centre axis 24 of the binding unit 2 relative to the latching slots 26 are offset by a distance 27 therefrom, the distance 27 corresponding to half the distance 25 between the latching slots 26. A spacing 28 between the locking bores 12 in the direction of the longitudinal centre axis 24 of the binding unit 2 again corresponds to the distance between the latching slots 26.

The locking device 10 for the front jaw 3 consists of the locking pin 11 which is mounted in a guide 29 of the housing 20 for adjustment in a vertical direction to a surface 30 of the ski 1. A locking extension 31 of the locking pin 11 in this case engages in the locked position of the front jaw 3 in one of the locking bores 12 and thus fixes the front jaw 3 in the longitudinal guide 8 in relation to the ski 1. On the side of the longitudinal guide 8 facing away from the ski 1, the locking pin 11 comprises a retaining attachment 32 of which the outside diameter 33 is larger than a diameter 34 of the locking bores 12. The retaining attachment 32 of the locking pin 11 is guided in a receiving chamber 35 of the housing 20, in which a compression device 36 in the form of a compression spring 37 is also arranged and presses the retaining attachment 32, which has a larger diameter than the locking pin 11, in the direction of an arrow 38 in the direction of the surface 30 of the ski 1.

On the end opposite the locking extension 31, the locking pin 11 comprises a control head 39 which likewise has a larger diameter than the locking pin 11. The control head 39 forms, on the side facing towards the retaining attachment 32, a stop edge 40 on which is supported a lifting member 41 of the adjusting device 13.

The adjusting device 13 for the locking device 10 consists of the lifting member 41 which is mounted rotatably in a cardan pivot device 42, as well as a pivot plate 43 which is connected to the lifting member 41 and which is provided on both sides with side strips 44 in the direction of the longitudinal centre axis 24 and forms stop faces 45 for the ski stick 14.

The cardan pivot device 42 consists of a pivot body 46 through which extends the lifting member 41 and on which are arranged on both sides journals 47 which are spaced apart from each other in the longitudinal direction of the ski and which are mounted rotatably in the housing 20 of the front jaw 3.

In FIG. 2 the locking device 10 as well as the adjusting device 13 are shown in each case in the inoperative position 15, whereas in FIG. 3 the locking device 10 is shown by means of the adjusting device 13 in its unlocked position or the engaged position of the pivot plate 43.

The lifting member 41 consists of a pivot pin 48 which extends through the pivot body 46, and a flange 49 opposite the pivot plate 43 and having a larger diameter than the pivot pin 48. The lifting member 41 is thus held in the direction of its pivot shaft 50, which is arranged in a plane transversely to the longitudinal centre axis 24 of the binding unit 2, on the one hand by the flange 49 and on the other hand by the pivot plate 43 in its position in relation to the pivot body 46. The flange 49 of the lifting member 41 comprises, on the end opposite the pivot body 46, an attachment 51 which diverges frustoconically in the direction of the locking pin 11 and which is engaged with the stop edge 40 of the control head 39. The housing 20 of the front jaw 3 comprises an aperture 52 in the pivot region of the attachment 51. But of course it is also possible to construct the lifting member 41 with the attachment 51 arranged thereon as a separate component and to mount it in the pivot body 46.

The pivot plate 43 comprises, on the end facing away from the ski 1, a contact face 53 which is supported in the inoperative position of the adjusting device 13 on a levelling face 54 of the housing 20. By cooperation of the contact face 53 with the levelling face 54, the pivot plate 43 is held in its inoperative position in a plane extending transversely to the longitudinal direction of the ski, in vertical alignment with the surface 30 of the ski 1.

Adjustment of the binding unit 2 in its position in relation to the ski 1 in the longitudinal direction thereof takes place as follows:

By insertion of the ski stick 14 in a recess 55 of the housing 20, the pivot plate 43 is pivoted about the journals 47 of the pivot body 46 in the direction of an arrow 56. After covering an adjusting distance 18 between the inoperative position 15 and the intermediate position 17 of the pivot plate 43, the spaced-apart latching projections 57 become engaged with the latching slots 26. In this case a distance 58 between the two latching projections 57 corresponds exactly to the distance 25 between the latching slots 26. In order to facilitate engagement of the latching projections 57 in the latching slots 26, the latter are of rounded shape in their end regions in order to prevent any jamming as well.

At the same time, by the pivot movement of the pivot plate 43 according to the arrow 56, the lifting member 41 is likewise pivoted up in the direction of an arrow 59 about the journals 47. By cooperation of the frustoconical attachment 51 with the stop edge 40, the locking pin 11 with its locking extension 31 is lifted against the spring force of the compression spring 37 and so lifted from its inoperative position 15 likewise into the intermediate position 17 shown in dot and dash lines. In this intermediate position 17, however, the locking extension 31 is still engaged with the locking bores 12 arranged in the longitudinal guide 8 and so prevents relative movement between the front jaw 3 and the ski 1 in the longitudinal direction of the ski from taking place before engagement of the latching projections 57 in the latching slots 26.

During further pivoting of the pivot plate 43 in the direction of the arrow 56, that is, into the engaged position 16—shown in unbroken lines in FIG. 3—that is, by the longer total adjusting distance 19 of the pivot plate 43, the locking extension 31 is then further lifted against the spring bias of the compression spring 37, this being until it is completely lifted out of the locking bore 12 in the longitudinal guide 8, as shown in unbroken lines in FIG. 3. As a result, pivoting of the pivot plate 43 about the pivot shaft 50, that is, in the longitudinal direction of the ski 1, is released, and so total adjustment of the binding unit 2 in the direction of the longitudinal guide 8 can take place. By unlocking of the locking device 10, however, due to cooperation of the latching projections 57 with the latching slots 26, there is no free mobility of the binding unit 2 in the longitudinal direction of the ski. The desired adjustment can take place in each case only in steps, wherein an adjusting distance 60 of a single step corresponds exactly to the spacing 28 between the locking bores 12 and is limited by stops 61 which are mounted in the housing 20 of the front jaw 3, as shown schematically in FIG. 4.

These stops 61 cooperate for example with the side strips 44 of the pivot plate 43. For this purpose the stops 61, as shown for example in FIG. 4, in the inoperative position 15 or the intermediate position 17 are arranged spaced apart from these side strips 44 by the same distance 62 in the longitudinal direction of the ski 1, wherein the distance 62 corresponding to a vertical distance 63 between the pivot shaft 50 and the stops 61 in relation to the maximum pivot angle between the pivot plate 43 and the housing 20 is smaller than the adjusting distance 60. Thus it is ensured that in each case upon abutment of the pivot plate 43 independently of the direction of adjustment against the stop 61, the locking extension 31 comes to lie in register with a locking bore 12 in the longitudinal guide 8 and so, on removal of the ski stick 14 from the housing 20 of the front jaw 3, the locking extension 31 can enter the locking bore 12 unhindered before the latching projections 57 leave the latching slots 26 of the longitudinal guide 8.

Hence it is ensured that after each locking operation, satisfactory fixing and locking of the front jaw 3 or, in the event that the rear jaw is adjusted, of the rear jaw 4 relative to the ski 1 takes place.

On selection of appropriate transmission ratios or pivot angles 64 and an appropriate arrangement and coordination of the stops 61, it is of course also possible to fix the adjusting distance 60 in such a way that adjustment of the front jaw 3 or rear jaw 4 is possible in each case maximally by twice the spacing 28 between two locking bores 12 in the longitudinal direction of the ski 1.

The ski stick 14 inserted in the front jaw 3 for adjustment is also held laterally in a plane aligned with the longitudinal direction of the ski, by the stop faces 45 formed by the side strips 44. To adjust the binding unit 2 in the direction of the tip of the ski, the ski stick inserted in the front jaw 3 is to be pivoted in the direction of an arrow 65, as shown in FIG. 1. By this pivot movement and by the latching projections 57 engaged in the latching slots 26, a driving connection is made between the front jaw 3, which is longitudinally movable in the longitudinal guide 8, as a result of which this jaw is moved further by the adjusting distance 60 relative to the longitudinal guide 8 or the ski 1 in the desired direction of adjustment.

Figure 4:
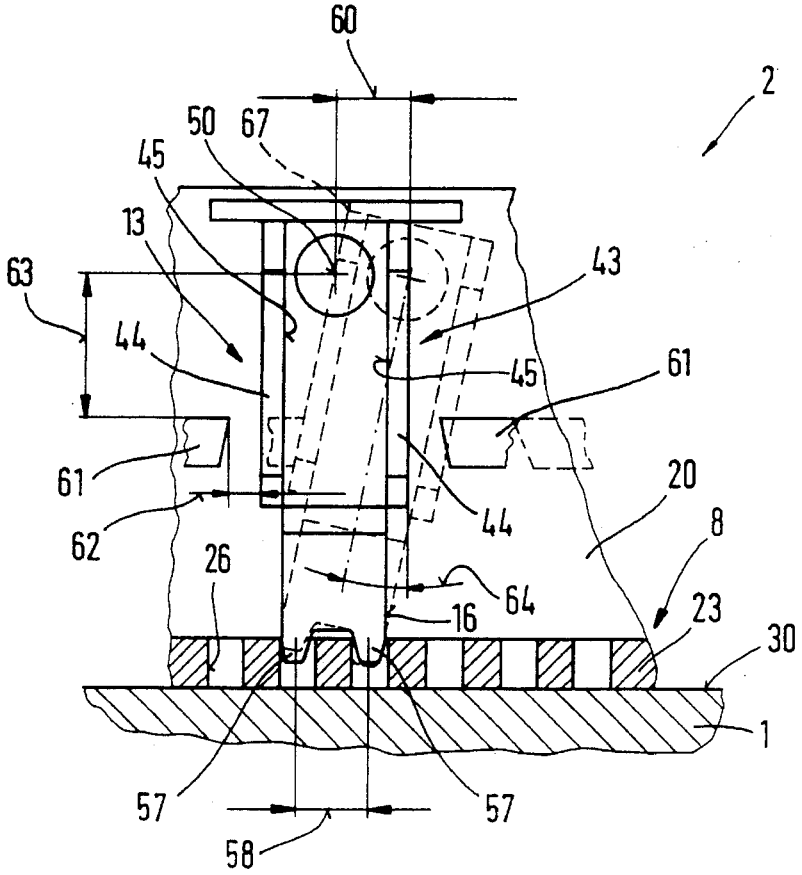
FIG. 4 part of the adjusting device in a highly schematically simplified side view.

In FIG. 4 in dashed lines is shown the inclined position of the pivot plate 43 which results upon pivot movement by the ski stick 14 of the user.

If movement of the ski stick 14 in the direction of an arrow 66 takes place, the binding unit 2 is moved by the corresponding adjusting distance 60 in the direction of the end of the ski.

With the construction of the locking and adjusting devices 10, 13 shown in FIGS. 2 to 5, it is necessary after each individual adjusting step by the respective adjusting distance 60 to disengage the ski stick 14 from the pivot plate 43 or the stop faces 45 of the side strips 44. For if the driving connection between the latching projections 57 with the latching slots 26 is not released or if these are not disengaged, it is not possible to perform a further adjusting operation.

For by removal of the ski stick 14 from the recess 55 of the front jaw 3, the locking pin 11 is moved on account of the compression device 36 in the direction of the arrow 38, as a result of which the locking extension 31 is engaged with one of the locking bores 12.

By this movement of the locking pin 11, forced actuation of the frustoconical attachment 51 takes place in cooperation with the stop edge 40 of the control head 39, as a result of which the lifting member 41 which extends through the cardan pivot device 42 is pivoted about the journals 47 in a direction counter to the arrow 59 and the pivot plate 43 connected to the lifting member is pivoted with its latching projections 57 out of the latching slots 26 into the inoperative position 15.

Due to this forcibly produced pivot movement of the cardan pivot device 42 about the journals 47, caused by the compression device 36 and the inclined position of the pivot plate 43 at the moment of disengagement of the ski stick 14, an edge 67 of the contact face 53 of the pivot plate 43 is supported on the levelling face 54 of the housing 20 of the front jaw 3. Due to coordination of the downward movement of the locking pin 11 in the direction of the arrow 38 as well as the pivot movement of the pivot device 42 and support of the edge 67 on the levelling face 54, the latching projections 57 leave the latching slots 26, and the pivot plate 43 can thus be oriented into a plane extending vertically to the surface 30 of the ski 1 and at right angles to the longitudinal centre axis 24, that is, into the inoperative position shown in unbroken lines in FIGS. 2 and 4. Thus again there is a snug fit of the contact face 53 against the levelling face 54, as shown in FIG. 2. By reinserting the ski stick 14 in the recess 55 of the front jaw 3, it is now possible again to perform a renewed adjusting operation by the adjusting distance 60 in one of the two directions according to the arrows 65, 66.

Thus, it is readily possible for the user of such a binding unit 2 to alter stepwise the position of the ski boot 9 which is desired individually at any given time, in relation to the position in the longitudinal direction of the ski 1, in order to apply more or less pressure to the front portion of the ski 1, depending on the purpose of use or the properties of the ski run. If the binding unit 2 is adjusted more in the direction of the tip of the ski, better edge grip of the ski 1 is achieved, which is necessary in case of hard or icy runs. If the binding unit 2 is adjusted in the direction of the end of the ski, by displacement of the point of application of the gravitational line of the body in the front region of the ski 1 more lift is achieved, such as entails a considerable facilitation for the user of such a binding unit 2 e.g. in deep snow travel.

In FIGS. 6–10 is shown another variant of a binding unit 2 according to the invention. Unlike the practical example shown in FIGS. 1 to 5, the binding unit 68 consists of the front jaw 3 and the rear jaw 4 which are connected to each other in the longitudinal direction at a fixed distance by a connecting element 5 which is flexible perpendicularly to the ski. The connecting element 5 consists of two sections 69, 70 which can be set to different positions relative to each other by a setting device 71, as a result of which the distance 6 between front jaw 3 and rear aw 4 can be adapted to the different sizes or sole lengths of ski boots 9.

Both the front jaw 3 and the rear jaw 4 are guided freely slidably in longitudinal guides 8 in this practical example. To position the binding unit 68 relative to the ski 1, the setting device 71 can be fixed to the locking device 10 in different positions via a retaining element 72 by means of an adjusting device 73.

Compared with the practical example according to FIGS. 1 to 5, in the present variant the adjusting device 73 is arranged on the ski 1 at a distance from and independently of the front jaw 3 or rear jaw 4. The retaining element 72 which is constructed rigidly and with tensile strength in the longitudinal direction and connects the adjusting device 73 to a housing or a retaining portion of the setting device 71 is used as the connection between the pivot plate 43 of the adjusting device 73 and the locking pin 11. To adapt the retaining element 72 to different degrees of deflection of the ski 1 or to retain the free deformability thereof, the retaining element 72 is however advantageously constructed flexibly or elastically deformably in a direction extending perpendicularly to the surface of the ski 1. Thus e.g. this retaining element 72 can be constructed after the fashion of a leaf spring element.

The adjusting device 73 and the locking device 10 are constructed follows:

To unlock the locking device 10 of the adjusting device 73 as well to actuate the adjusting device 13, again an actuating member such as e.g. a ski stick 14 can be used, for which purpose an opening 75 for introducing the ski stick 14 can be provided in a housing 74 of the adjusting device 73.

Figure 7:
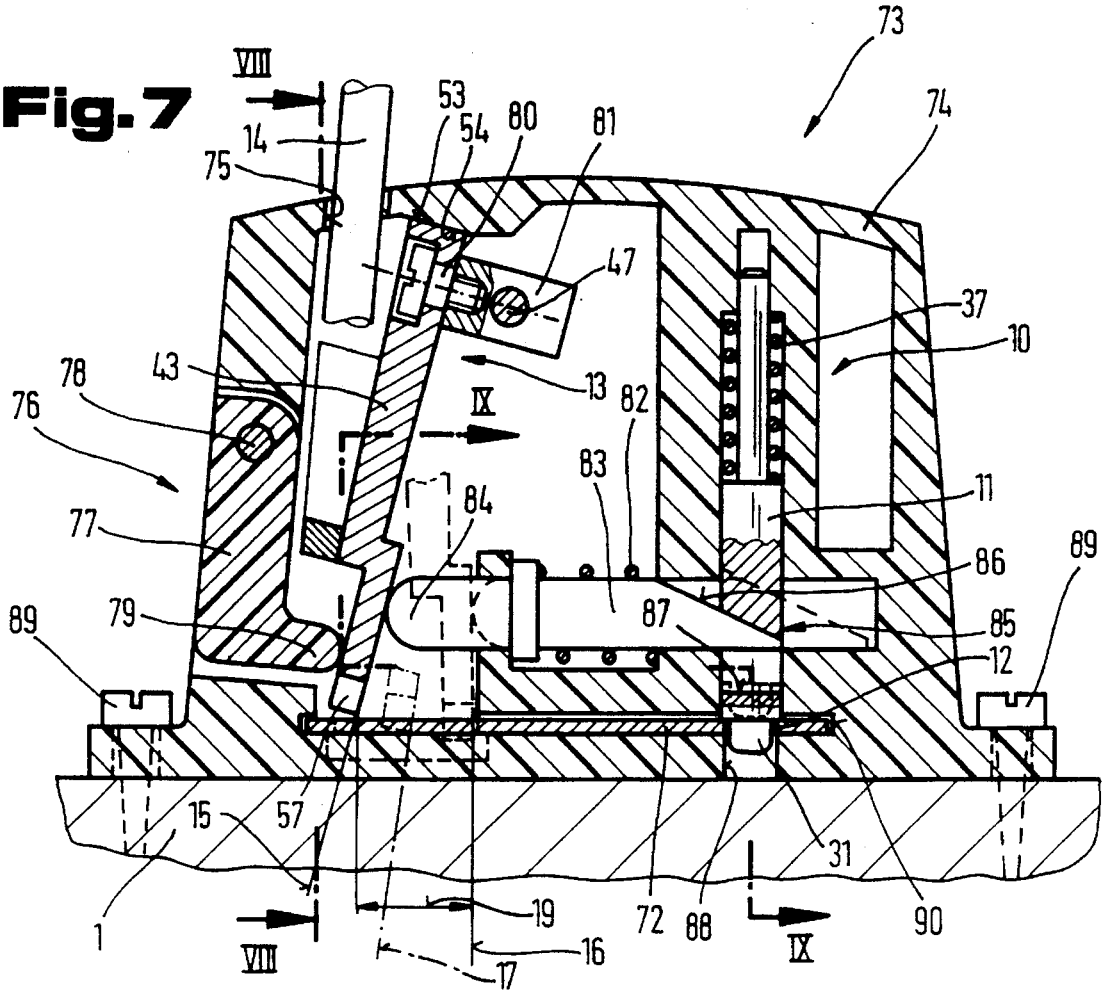
FIG. 7 a section through the adjusting device for the binding unit according to FIG. 6 in an end view, in section along the lines VII—VII in FIG. 6.

In addition to this possibility of actuating the adjusting device 13 and the locking device 10 with the ski stick 14, which has already been described before, there is provided an actuating element 76 which can be formed by a pivot lever 77—FIG. 7. This pivot lever 77, which can simultaneously also form an outer surface of the housing 74, is pivotable about a shaft 78 extending parallel to the longitudinal direction of the ski 1 or to the longitudinal direction of the retaining element 72, and has a more or less L-shaped cross-section in the longitudinal direction of the retaining element 72. An arm 79 of the pivot lever 77 in this case comes into abutment with the pivot plate 43 which is pivotable about a pivot pin 80 which extends transversely to the longitudinal direction of the retaining element 72 and is supported in a bearing portion 81 which is for its part pivotable about the journal 47 which is in turn oriented parallel and in the longitudinal direction to the retaining element 72.

Figure 5:
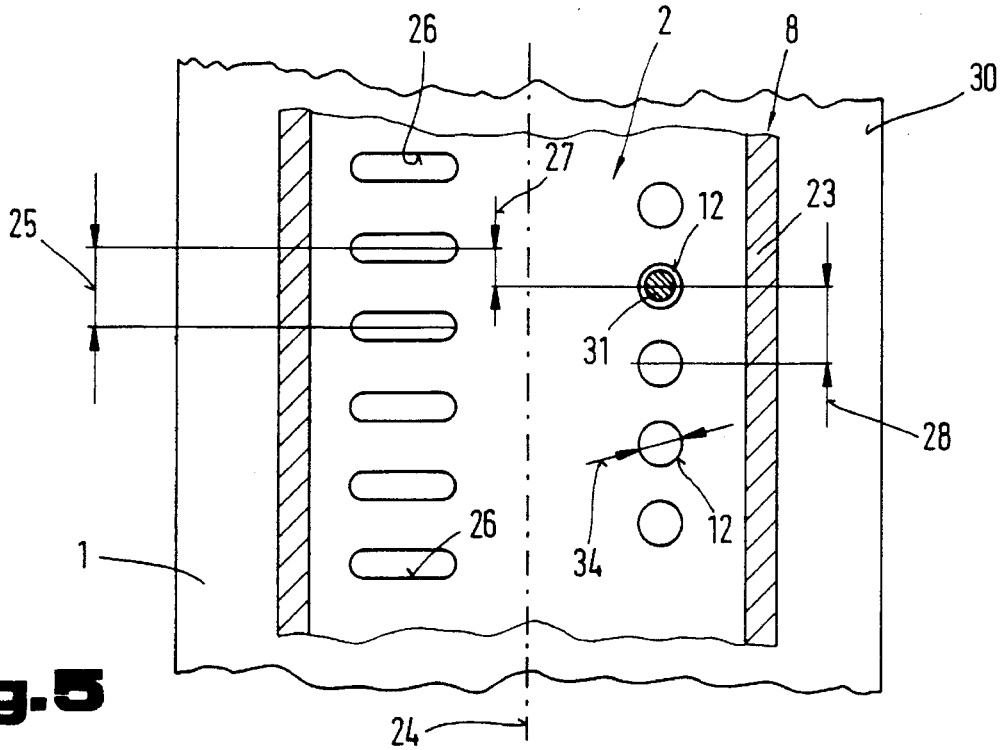
FIG. 5 the longitudinal guide in a top view, in section along the lines V—V in FIG. 2.
Figure 6:
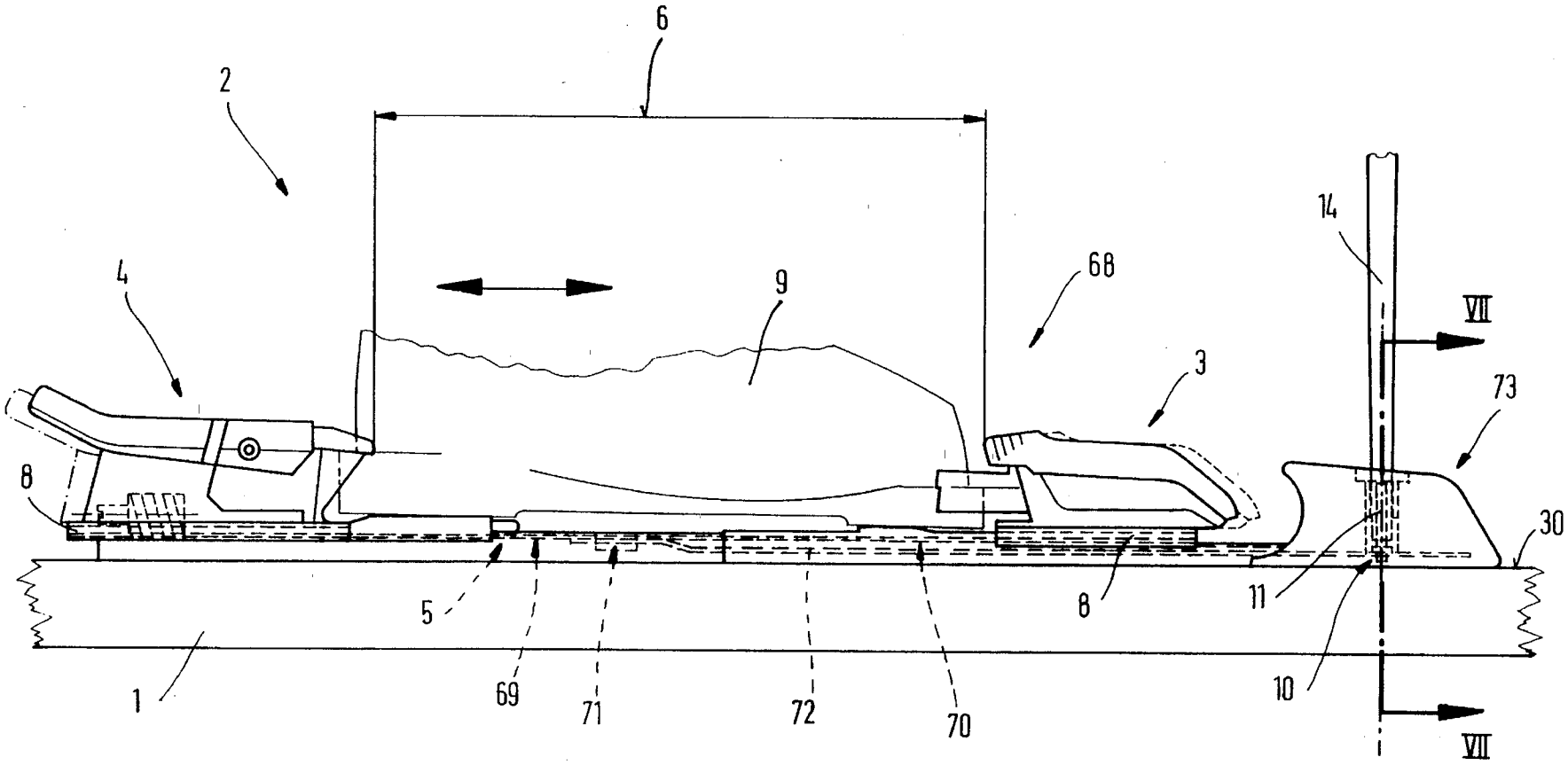
FIG. 6 another embodiment of a binding assembly according to the invention, in which the binding unit is fixed only in the central region between front and rear jaws relative to the ski, in a simplified schematic side view.
Figure 8:
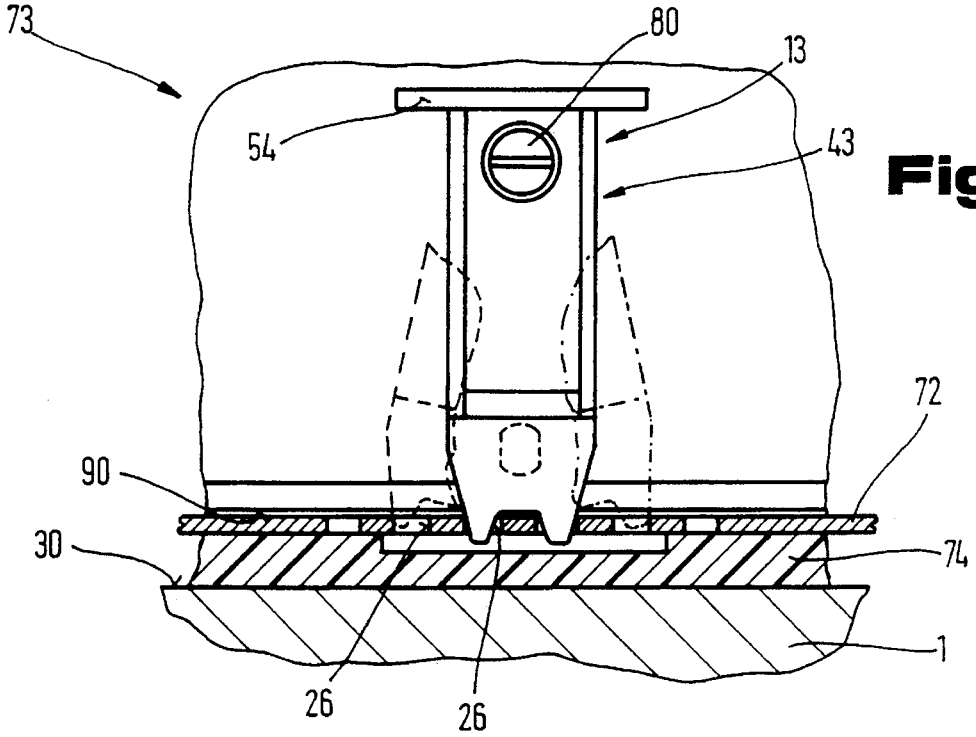
FIG. 8 part of the adjusting device in a highly simplified schematic side view, in section along lines VIII—VIII in FIG. 7.

But whereas the arrangement of the pivot plate 43 in relation to the pivot pin 80 takes place in order to allow pivoting of the pivot plate 43, for example according to the detailed descriptions in FIGS. 4 and 5, in a plane extending in the longitudinal direction of the retaining element 72, as also shown schematically in FIG. 8 in dashed and dot and dash lines and abuts against a contact face 53 for orientation in the central position shown in unbroken lines in FIG. 8, to actuate the locking device 10, in particular the locking pin 11, there is provided a thrust pin 83 mounted slidably against the action of a spring 82 transversely to the longitudinal direction of the retaining element 72. This thrust pin 83 on the side facing towards the pivot plate 43 abuts against the pivot plate 43 via an end 84 of e.g. universal ball joint-like construction, and is provided in the region of its opposite end 85 with an obliquely ascending connecting link track 86. This thrust pin 83 extends through the locking pin 11 for example in a slot 87.

In the position of the pivot plate 43 shown in FIG. 7 in the inoperative position 15 in which also the locking extension 31 engages in the locking bore 12 in the retaining element 72 and, as in the variant shown, also in a supporting bore 88 of the housing 74, the position of the retaining element 72 is fixed relative to the housing which is fixed to the ski 1 with fastening means 89.

The locking pin 11 as well as the locking extension 31 and the pivot plate 43 are held in their position shown in unbroken lines by the compression spring 37 or the spring 82.

In order to allow adjustment of the binding unit 68 in the longitudinal direction of the ski 1, as in the embodiment according to FIGS. 1 to 5 the pivot plate 43 is to be pivoted out of the inoperative position 15 shown in unbroken lines into the engaged position 16 shown in dashed lines. This can now take place by means of the ski stick 14 or by means of the actuating element 76. In both cases the pivot plate 43 is pivoted against the action of the spring 82 or compression spring 37, displacing the thrust pin 83. During pivoting of the pivot plate 43 into the intermediate position 17 in which the latching projections 57 engage in latching slots 26 of the retaining element 72, the locking extension 31 is lifted via the connecting link track 86, but is still engaged, at least with the retaining element 72. Only when the pivot plate 43 is adjusted by the greater second adjusting distance 19—that is, in the position shown in dashed lines—has the locking extension 31 too, as also shown in dashed lines, left the locking bore 12 in the retaining element 72, and the retaining element 72 can now be adjusted relative to the housing 74 in the longitudinal direction of the ski 1 by pivoting the pivot plate 43 into the position shown in dashed or dot and dash lines in FIG. 8. Hence the whole binding unit 68 is adjusted in position relative to the ski out of the position shown in unbroken lines into the one shown in dashed lines or in dot and dash lines.

As can be seen better from FIGS. 8 and 10, with an adjusting operation of the pivot plate 43 out of the inoperative position 15 shown in unbroken lines into the pivot position in dashed or dot and dash lines which is needed depending on the direction of movement of the binding unit 68 relative to the ski 1, the housing 74 remains in its relative position to the ski 1 in an unchanged position, and only the retaining element 72 is moved in a guide track 90 relative to the housing 74 or to a base plate 91 by the distance 25 between two latching slots 26 arranged in the retaining element 72.

In any case the supporting bore 88, if any, is located more or less centrally between the latching projections 57 of the pivot plate 43 when the latter is in its inoperative position 15 shown in unbroken lines.

Likewise the locking bores 12 are offset in the retaining element 72 from the latching slots 26 by a distance 27 which corresponds to half the distance 25 between the latching slots 26 immediately adjacent to each other in the longitudinal direction of the retaining element 72.

The distance 25 between the latching slots 26 in this case corresponds to the spacing 28 between the locking bores 12.

The positions of the pivot plate 43 and locking pin 11 shown in FIGS. 8 and 9 relate to the engaged position 16 of the pivot plate 43 with the retaining element 72 and the unlocked position of the locking pin 11 respectively.

In the construction of the pivot plate 43 according to the embodiment in FIGS. 6–10 too, associated with the contact face 53 on the side of the pivot plate 43 facing away from the latching projections 57 is a levelling face 54 in the housing 74. By the levelling face 54, the pivot plate 43 is pivoted after each adjusting operation by a distance 25 back into the inoperative position 15 shown in dashed or dot and dash lines. Thus, on removal of the ski stick 14 or on release of the actuating element 76, the pivot plate 43 is released and automatically returned to the inoperative position again and again. Hence, during a further adjusting operation movement of the binding unit 68 by a further distance 25, that is, the distance between two latching slots 26 immediately adjacent to each other in the longitudinal direction of the retaining element 72 is made possible.

The advantage of this arrangement lies in that both the front jaw 3 and the rear jaw 4 are mounted freely slidably in the longitudinal guides associated with them during use of the ski 1, and hence high flexibility in mobility between the binding unit 68 and the front or rear jaw 3, 4 is achieved. Thus stiffening of the ski is particularly also further prevented by the fact that the setting device 71 can be freely vertically movable, that is, adjustable perpendicularly to an assembly plane of the binding unit 68 on the ski 1, so that vertical deflection of the ski 1 relative to the binding unit 68 fixed to the ski 1 is not hindered by the binding unit 68.

By this construction of the adjusting device 73, above all by the use of a rod-shaped actuating member, in particular the ski stick 14, adjustment of the binding unit 68 relative to the ski 1 is made possible when the ski boot 9 is mounted in the binding unit 68 too. Thus during use of the ski 1 easy setting of the optimum point of fixing to the ski 1 is obtainable without the ski 1 having to be released from the ski boot 9.

But nevertheless by the corresponding design of the adjusting device 13 or adjusting device 73 it is ensured that during assembly or maintenance of the binding unit 68, adjustment and setting can take place just as quickly and easily. Thus during assembly or when the ski boot 9 is removed from the binding unit, with the arrangement of the pivot lever 77 it is possible in a simple manner manually by hand operation to activate the adjusting device 13 or the adjusting device 73, i.e. to release the locking between the front jaw 3 and the ski 1 or between the adjusting device 73 and the retaining element 72, and to perform forward adjustment in each case by an adjusting step in the direction of the front jaw 3 or in the direction of the rear jaw 4. Due to stop limiting of the pivot plate 43, or this may of course also involve a shaped portion or a tubular retaining portion with projecting tooth segments or the like, not only is the maximum possible adjusting distance in an adjusting operation fixed, but furthermore it is also ensured that in the respective stop-limited end position of the pivot plate 43 the locking pin 11 of the locking device 10 is always in a position of register with the locking bore 12 or the locking bore or the supporting bore 88 and thus safe locking or fixing of the binding unit 68 relative to the front or rear jaw 3, 4 or the retaining element 72 takes place automatically on release of the driving connection of the adjusting device 13.

In FIG. 11 is shown another variant in which the latching projections 57 or the tooth segments arranged on the pivot device 42 or the pivot plate 43 engage in a toothed strip 92 which is attached to the ski 1 by its own fastening means 93. On this toothed strip 92 are arranged, at the same distance 25 as the latching slots 26 in the view in FIG. 5, teeth 94 between which engage the latching projections 57 or teeth or tooth segments of the pivot lever formed by a pivot plate 43.

As further shown, it is also possible for the locking pin 11 to engage in its own locking strip 95 or locking bores 12 arranged in this locking strip 95, wherein this locking strip 95 too can be attached to the ski 1 by its own fastening means 93, e.g. independently of the longitudinal guide 8. With appropriate choice of design of the locking and adjusting devices 10 and 13 respectively, it is also possible to construct the tooth strips 92 and the locking strip 95 as a common one-piece component which can be arranged independently of the longitudinal guide 8.

Figure 13:
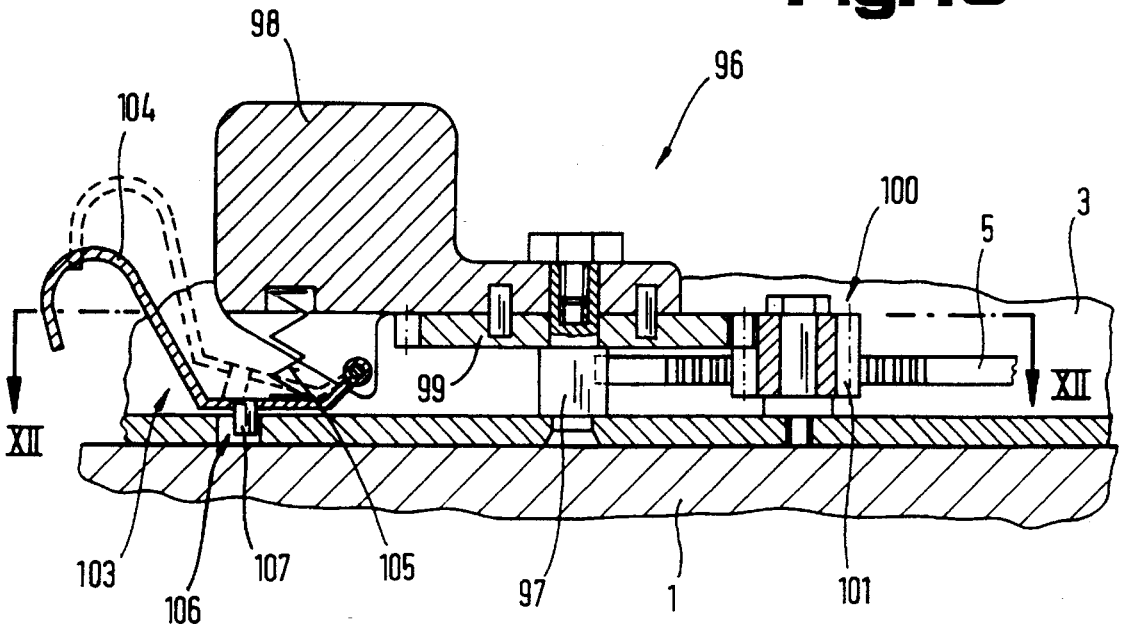
FIG. 13 the adjusting device according to FIG. 12 in a highly simplified side view, partly in section.

In FIGS. 12 and 13 is shown another adjusting device 96 with which e.g. the front jaw 3 of a binding unit 2 can be adjusted in the longitudinal direction of a connecting element 5. For this purpose e.g. in front of the front jaw 3 is arranged an actuating member 98 pivotable about a shaft 97, e.g. an actuating handle. This actuating member 98 is coupled to a gear 99, so that on pivoting the actuating member 98 about the shaft 97, the gear 99 is pivoted by the same amount or angle. By a gear transmission 100, by means of a driving gear 101 e.g. a gear which meshes with the connecting element 5 provided with a rack, by pivoting of the actuating member 98 according to an arrow 102 clockwise or anti-clockwise, adjustment of the binding unit consisting of the front jaw 3 and rear jaw 4 fixed to the connecting element 5 can take place in the longitudinal direction of the connecting element 5. The connecting element 5 can itself e.g. on one longitudinal side be provided with teeth, or a toothed strip may be mounted thereon.

As can be seen better from FIG. 13, in the region of the actuating member 98 can also be provided a locking device 103 which is formed e.g. from an actuating element 104 which, against the action of a spring element 105 e.g. a leaf spring, a coil spring or an elastic element made of rubber or plastic, presses a locking pin 106 in the direction of the bearing surface of the adjusting device 96 or the ski 1. As a result, a projecting locking extension 107 arranged on the actuating member 98 and formed by the locking pin 106 is fixed in position, and therefore adjustment of the actuating member 98 and therefore also of the binding unit can be safely avoided. In order to set the desired position of the binding unit relative to the ski 1, the actuating element 104 need only be lifted against the action of the spring element 105, and the actuating member 98 moved back and forth in the direction of the arrow 102 until in the region of the desired position the locking extension 107 engages in the locking bore 108 which is associated therewith and which can be formed e.g. by a bore as well.

If the actuating element 104 is released immediately after the commencement of the rotary movement of the actuating member 98, at the next locking bore 108 the actuating member 98 automatically engages in the locking bore 108 by cooperation of the locking extension 107 with the spring element 105 directed counter to it, and full operational reliability of the binding unit is ensured again immediately.

Naturally it is possible to arrange any other locking device, e.g. currently known locking devices too such as e.g. a pivotable cover which is arranged on the front jaw 3 and by which the locking pin is actuated.

Another advantage of this arrangement lies in that by the position of the actuating member 98, at the same time the relative position of the binding unit as seen in the longitudinal direction of the ski is shown and hence the respective setting on the ski is immediately indicated to the user. At the same time, as a result there is prevention in a simple manner of e.g. the binding units on the two skis being in unequal positions in relation to the longitudinal direction of the ski 1.

Naturally, to limit the adjusting distance of the binding unit it is also possible to integrate the adjusting mechanism described with the aid of FIGS. 1 to 11, consisting of the locking pin and the pivot lever, in the actuating member 98, so that for example in case of direct or indirect movement of the pivot plate 43 or of a corresponding other component, the fixing of the binding unit relative to the ski is released by the fact that the locking pin 106 is pulled out of the locking bore 108, whereupon, due to limiting with the pivot plate 43, the actuating member 98 can be adjusted by a notch spacing or the distance between two locking bores 108 immediately adjacent to each other, whereupon after release of the locking device 103 the pivot plate 43 can pivot back into its starting position again in order, if desired, to adjust the whole binding unit by a further spacing. Naturally the corresponding latching slots 26 or the locking bores 12 would then have to be arranged in a radius corresponding to the pivot radius of the actuating member 98, about the shaft 97 of the gear 99.

For regularity's sake it should also be mentioned in conclusion that the drawings are shown in parts distorted and not to scale, for a better understanding of the effects according to the invention. Individual characteristics or groups of characteristics can also form in each case their own independent solutions according to the invention, irrespective of the groups of characteristics characterised in the patent claims.

Above all, the individual constructions shown in FIGS. 1 to 5, 6 to 10, 11, 12, 13 can form the subject of independent solutions according to the invention. The objects and solutions according to the invention in this respect can be found in the detailed descriptions of these figures.

What is claimed is:

1. A binding unit for attaching a boot to an item of sports equipment, which comprises (a) a front jaw, (b) a rear jaw, (c) a guide arrangement for connection to a surface of the item of sports equipment, the guide arrangement comprising (1) a longitudinal guide track for the front and rear jaws enabling the front and rear jaws to be adjusted in a longitudinal direction, (d) a longitudinally adjustable connecting element connecting the front and rear jaws for common adjustment of the front and rear jaws along the longitudinal guide track, (e) a locking device for retaining one of the jaws in a predetermined position relative to the item of sports equipment in the longitudinal direction, the locking device being adjustable between a retaining position, an intermediate position and an inoperative position, (f) an adjusting device comprising a movable setting member, (1) the setting member being in adjusting connection with the locking device for adjusting the locking device in a respective one of said positions, and (2) the movable setting member being arranged to receive an actuating member applying moving pressure on the setting member, (g) a housing for the locking and adjusting devices, (1) the setting member including a pivot plate mounted on the housing, and (2) the adjusting device comprising a cardan pivot device about which the pivot plate may be moved with respect to the housing, and (h) latching elements spaced apart in the longitudinal direction and affixable to the item of sports equipment, and the movable setting member of the adjusting device being (1) selectively engageable with the latching elements and (2) movable under the moving pressure by a first adjusting distance between two of said latching elements and by a second, additional adjusting distance to a position to adjust the locking device in the inoperative position.

2. The binding unit of claim 1, wherein the cardan pivot device includes a journal extending substantially parallel to the longitudinal direction and mounting the cardan pivot device for rotation in the housing, and the pivot plate is pivotal about the journal and a pivot axis extending substantially perpendicularly to the longitudinal direction.

3. The binding unit of claim 2, wherein the cardan pivot device includes a pivot body, and the adjusting device further includes a pivot pin attached to the pivot plate and passing through the pivot body for rotation about the pivot axis.

4. The binding unit of claim 3 wherein the adjusting device further includes a lifting member attached to the pivot pin and projecting from an end of the pivot pin remote from the pivot plate beyond the pivot body.

5. The binding unit of claim 4, wherein the locking device comprises a locking pin, the locking pin has a control head, and the lifting member has an attachment in engagement with the control head of the locking pin.

6. The binding unit of claim 5, wherein the locking pin has a locking extension engaging a locking bore in the longitudinal guide track when the pivot plate is out of engagement with the locking slots.

7. The binding unit of claim 6, further comprising a compression device biasing the locking extension towards the locking bore.

8. The binding unit of claim 6, wherein the locking extension is held out of engagement with the locking bore by the lifting member engaging the control head of the lifting pin when the pivot plate engages the locking slots.

9. The binding unit of claim 1, wherein the pivot plate extends in a plane extending substantially vertical to the surface of the item of sports equipment and parallel to the longitudinal direction when the pivot plate engages the locking slots.

10. The binding unit of claim 1, wherein the cardan pivot device is arranged at an end of the pivot plate remote from the latching elements, and an opposite end of the pivot plate adjacent the latching elements comprises two latching projections projecting towards the longitudinal guide track, adjacent ones of the latching elements being latching slots in the guide track, the two latching projections being spaced at a distance from each other which substantially corresponds to the distance between adjacent ones of the latching slots in the longitudinal direction.

11. The binding unit of claim 1, wherein the housing defines a recess arranged for introducing a rod-shaped actuating member to apply said moving pressure to the pivot plate, and the pivot plate comprises side strips projecting towards an inner wall of the housing for guiding the rod-shaped actuating member along the pivot plate.

12. The binding unit of claim 11, wherein the side strips at an end of the pivot plate adjacent the latching elements form a stop with the inner housing wall.

13. The binding unit of claim 1, wherein the latching elements are slots.

14. A binding unit for attaching a boot to an item of sports equipment, which comprises (a) a front jaw, (b) a rear jaw, (c) a guide arrangement for connection to a surface of the item of sports equipment, the guide arrangement comprising (1) a longitudinal guide track for the front and rear jaws enabling the front and rear jaws to be adjusted in a longitudinal direction, (d) a longitudinally adjustable connecting element connecting the front and rear jaws for common adjustment of the front and rear jaws along the longitudinal guide track, (e) a locking device for retaining one of the jaws in a predetermined position relative to the item of sports equipment in the longitudinal direction, the locking device being adjustable between a retaining position, an intermediate position and an inoperative position, (f) an adjusting device comprising a movable setting member, (1) the setting member being in adjusting connection with the locking device for adjusting the locking device in a respective one of said positions, and (2) the movable setting member being arranged to receive an actuating member applying moving pressure on the setting member, and (g) latching elements spaced apart in the longitudinal direction and affixable to the item of sports equipment, and the movable setting member of the adjusting device being (1) selectively engageable with the latching elements, (2) disengaged from the latching elements when the locking device is in the retaining position, and (3) movable under the moving pressure by a first adjusting distance between two of said latching elements and by a second, additional adjusting distance to a position to adjust the locking device in the inoperative position.

15. The binding unit of claim 14, wherein the movable setting member includes a pivot plate having two latching projections projecting towards the longitudinal guide track, the two latching projections being spaced at a distance from each other which substantially corresponds to the distance between adjacent ones of the latching elements in the longitudinal direction, the guide track comprising a C-shaped profile including a base, the latching elements being latching slots in the base, and the latching projections being above the base when the locking device is in the retaining position.

16. The binding unit of claim 15, wherein the latching projections engage two adjacent latching slots when the locking device is in the inoperative position.

17. A binding unit for attaching a boot to an item of sports equipment, which comprises (a) a front jaw, (b) a rear jaw, (c) a guide arrangement for connection to a surface of the item of sports equipment, the guide arrangement comprising (1) a longitudinal guide track for the front and rear jaws enabling the front and rear jaws to be adjusted in a longitudinal direction, (d) a longitudinally adjustable connecting element connecting the front and rear jaws for common adjustment of the front and rear jaws along the longitudinal guide track, (e) a locking device for retaining one of the jaws in a predetermined position relative to the item of sports equipment in the longitudinal direction, the locking device being adjustable between a retaining position, an intermediate position and an inoperative position, the locking device comprising (1) a locking pin adjustable into and out of engagement with locking bores, (f) an adjusting device comprising a movable setting member, (1) the setting member being in adjusting connection with the locking device for adjusting the locking device in a respective one of said positions, and (2) the movable setting member being arranged to receive an actuating member applying moving pressure on the setting member, and (g) latching elements spaced apart in the longitudinal direction and affixable to the item of sports equipment, the locking bores being staggered from the latching elements in the longitudinal direction by a distance corresponding to half the distance of the spacing between the latching elements, and the movable setting member of the adjusting device being (1) selectively engageable with the latching elements, (2) disengaged from the latching elements when the locking device is in the retaining position, and (3) movable under the moving pressure by a first adjusting distance between two of said latching elements and by a second, additional adjusting distance to a position to adjust the locking device in the inoperative position.

18. The binding unit of claim 17, wherein the spacing between the latching slots is equal to the spacing between the locking bores.

19. The binding unit of claim 17, wherein the locking bores and latching slots are arranged in rows extending in the longitudinal direction.

20. The binding unit of claim 17, wherein the locking bores and latching slots are defined in the longitudinal guide track.

21. A binding unit for attaching a boot to an item of sports equipment, which comprises (a) a front jaw, (b) a rear jaw, (c) a guide arrangement for connection to a surface of the item of sports equipment, the guide arrangement comprising (1) a longitudinal guide track for the front and rear jaws enabling the front and rear jaws to be adjusted in a longitudinal direction, (d) a longitudinally adjustable connecting element connecting the front and rear jaws for common adjustment of the front and rear jaws along the longitudinal guide track, (e) a locking device for retaining one of the jaws in a predetermined position relative to the item of sports equipment in the longitudinal direction, the locking device being adjustable between a retaining position, an intermediate position and an inoperative position, (f) a housing for the locking device, (1) the locking device comprising a locking pin and the housing comprising (2) a guide longitudinally slidably supporting the locking pin, (g) an adjusting device comprising a movable setting member, (1) the setting member being in adjusting connection with the locking device for adjusting the locking device in a respective one of said positions, and (2) the movable setting member being arranged to receive an actuating member applying moving pressure on the setting member, and (h) latching elements spaced apart in the longitudinal direction and affixable to the item of sports equipment, and the movable setting member of the adjusting device being (1) selectively engageable with the latching elements and (2) movable under the moving pressure by a first adjusting distance between two of said latching elements and by a second, additional adjusting distance to a position to adjust the locking device in the inoperative position.

22. A binding unit for attaching a boot to an item of sports equipment, which comprises (a) a front jaw, (b) a rear jaw, (c) a guide arrangement for connection to a surface of the item of sports equipment, the guide arrangement comprising (1) a longitudinal guide track for the front and rear jaws enabling the front and rear jaws to be adjusted in a longitudinal direction, (d) a longitudinally adjustable connecting element connecting the front and rear jaws for common adjustment of the front and rear jaws along the longitudinal guide track, (e) a locking device for retaining one of the jaws in a predetermined position relative to the item of sports equipment in the longitudinal direction, the locking device being adjustable between a retaining position, an intermediate position and an inoperative position, (f) an adjusting device comprising a movable setting member, (1) the setting member being in adjusting connection with the locking device for adjusting the locking device in a respective one of said positions, and (2) the movable setting member being arranged to receive an actuating member applying moving pressure on the setting member, (g) a housing for the adjusting device, (1) the setting member including a pivot plate mounted in the housing, and (2) the pivot plate having a stop for an end of the actuating member received in the setting member, the stop projecting from the pivot plate towards the housing, and (h) latching elements spaced apart in the longitudinal direction and affixable to the item of sports equipment, and the movable setting member of the adjusting device being (1) selectively engageable with the latching elements and (2) movable under the moving pressure by a first adjusting distance between two of said latching elements and by a second, additional adjusting distance to a position to adjust the locking device in the inoperative position.

23. The binding unit of claim 22, wherein the pivot plate has a contact face engaging a levelling face of the housing when the pivot plate is in a position out of engagement with the latching elements.

24. A binding unit for attaching a boot to an item of sports equipment, which comprises (a) a front jaw, (b) a rear jaw, (c) a guide arrangement for connection to a surface of the item of sports equipment, the guide arrangement comprising (1) a longitudinal guide track for the front and rear jaws enabling the front and rear jaws to be adjusted in a longitudinal direction, (d) a longitudinally adjustable connecting element connecting the front and rear jaws for common adjustment of the front and rear jaws along the longitudinal guide track, (e) a locking device for retaining one of the jaws in a predetermined position relative to the item of sports equipment in the longitudinal direction, the locking device comprising a locking pin adjustable between a retaining position, an intermediate position and an inoperative position, (f) an adjusting device comprising a movable setting member, the setting member comprising (1) a pivot plate in adjusting connection with the locking pin for adjusting the locking pin in a respective one of said positions, (2) the movable setting member being arranged to receive an actuating member applying moving pressure on the setting member, and (g) latching elements spaced apart in the longitudinal direction and affixable to the item of sports equipment, and the movable setting member of the adjusting device being (1) selectively engageable with the latching elements and (2) movable under the moving pressure by a first adjusting distance between two of said latching elements and by a second, additional adjusting distance to a position to adjust the locking device in the inoperative position, the locking pin and the pivot plate having longitudinal axes extending substantially parallel to each other when the pivot plate engages the latching elements.

25. A binding unit for attaching a boot to an item of sports equipment, which comprises (a) a front jaw, (b) a rear jaw, (c) a guide arrangement for connection to a surface of the item of sports equipment, the guide arrangement comprising (1) a longitudinal guide track for the front and rear jaws enabling the front and rear jaws to be adjusted in a longitudinal direction, (d) a longitudinally adjustable connecting element connecting the front and rear jaws for common adjustment of the front and rear jaws along the longitudinal guide track, (e) a locking device for retaining one of the jaws in a predetermined position relative to the item of sports equipment in the longitudinal direction, the locking device being adjustable between a retaining position, an intermediate position and an inoperative position, (f) an adjusting device comprising a movable setting member, the setting member comprising (1) a pivot plate in adjusting connection with the locking device for adjusting the locking device in a respective one of said positions, (2) the movable setting member being arranged to receive an actuating member applying moving pressure on the setting member, (g) a housing for the adjusting device, (1) the setting member including a pivot plate mounted in the housing and having a pivot axis, and (2) the housing including stops spaced in the longitudinal direction to define an aperture through which the pivot plate extends, and (h) latching elements spaced apart in the longitudinal direction and affixable to the item of sports equipment, the stops being centered relative to the pivot axis when the pivot plate engages the latching elements, and the movable setting member of the adjusting device being (1) selectively engageable with the latching elements and (2) movable under the moving pressure by a first adjusting distance between two of said latching elements and by a second, additional adjusting distance to a position to adjust the locking device in the inoperative position.

26. A binding unit for attaching a boot to an item of sports equipment, which comprises (a) a front jaw, (b) a rear jaw, (c) a guide arrangement for connection to a surface of the item of sports equipment, the guide arrangement comprising (1) a longitudinal guide track for the front and rear jaws enabling the front and rear jaws to be adjusted in a longitudinal direction, (d) a longitudinally adjustable connecting element connecting the front and rear jaws for common adjustment of the front and rear jaws along the longitudinal guide track, (e) a locking device for retaining one of the jaws in a predetermined position relative to the item of sports equipment in the longitudinal direction, the locking device comprises a locking pin having a control head adjustable between a retaining position, an intermediate position and an inoperative position, (f) an adjusting device comprising (1) a movable setting member arranged to receive an actuating member applying pressure on the setting member, (2) a pivot body for the setting member and (3) a lifting member attached to the pivot body, the lifting member having an attachment engaging the control head and being in adjusting connection with the locking pin for adjusting the locking pin in a respective one of said positions, and (g) latching elements spaced apart in the longitudinal direction and affixable to the item of sports equipment, and the movable setting member of the adjusting device being (1) selectively engageable with the latching elements and (2) movable under the moving pressure by a first adjusting distance between two of said latching elements and by a second, additional adjusting distance to a position to adjust the locking device in the inoperative position.

* * * * *